United States Patent [19]

Batts, III

[11] Patent Number: 4,940,244

[45] Date of Patent: Jul. 10, 1990

[54] ARCHERY TARGET

[75] Inventor: John W. Batts, III, Lincoln, Mo.

[73] Assignee: Christine R. Batts, Foley, Mo.; a part interest

[21] Appl. No.: 410,149

[22] Filed: Sep. 20, 1989

[51] Int. Cl.[5] ..... F41J 3/00

[52] U.S. Cl. ..... 273/403

[58] Field of Search ..... 273/403

[56] References Cited

U.S. PATENT DOCUMENTS

| | | | |
|---|---|---|---|
| 271,647 | 2/1883 | Medart | 273/403 X |
| 3,329,431 | 7/1967 | Roesner | 273/403 |
| 4,195,839 | 4/1980 | Rodrique | 273/403 |
| 4,235,444 | 11/1980 | Meyer | 273/403 |
| 4,294,452 | 10/1981 | Schlotter et al. | 273/403 |
| 4,813,684 | 3/1989 | Bruno | 273/403 |

*Primary Examiner*—William H. Grieb

*Attorney, Agent, or Firm*—Kalish & Gilster

[57] ABSTRACT

A modular archery target comprises upright supports mounted upon and extending upwardly from lateral base members. Between the upright supports a target body is suspended by a first rod and supported on a plurality of lower rods, which rods interconnect the upright supports. The target body is comprised of elongated modules of substantially identical construction, being of laminated, corrugated sheets. One end of each rod is substantially fixed to one upright support, and the other rod end is adjustable for tightening and compressing the target body modules between the upright supports as necessary.

12 Claims, 2 Drawing Sheets

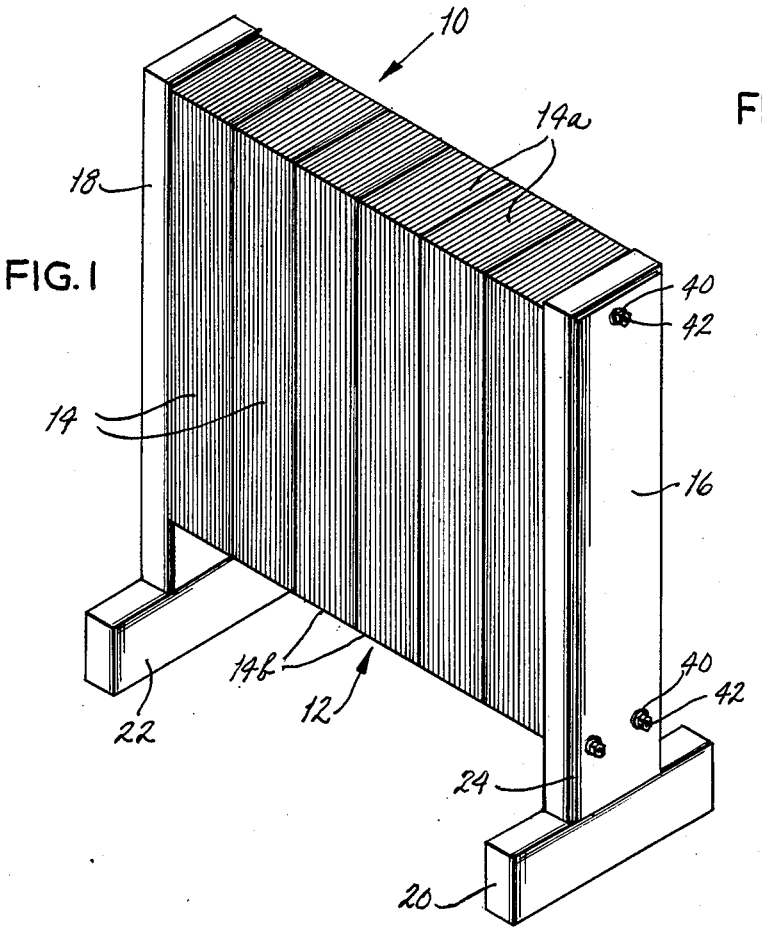
FIG. 1
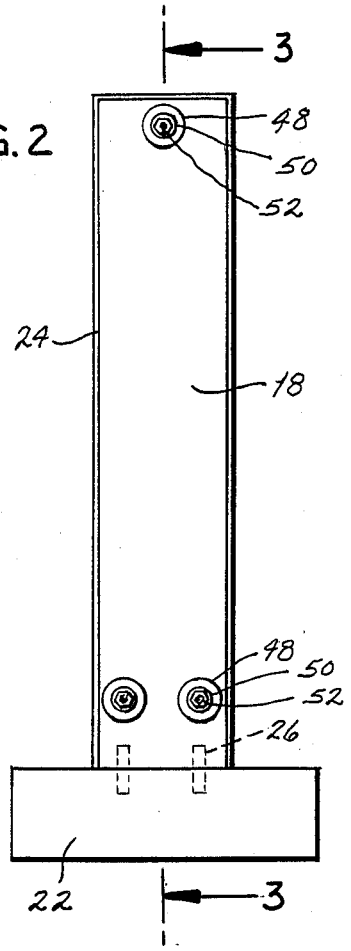
FIG. 2
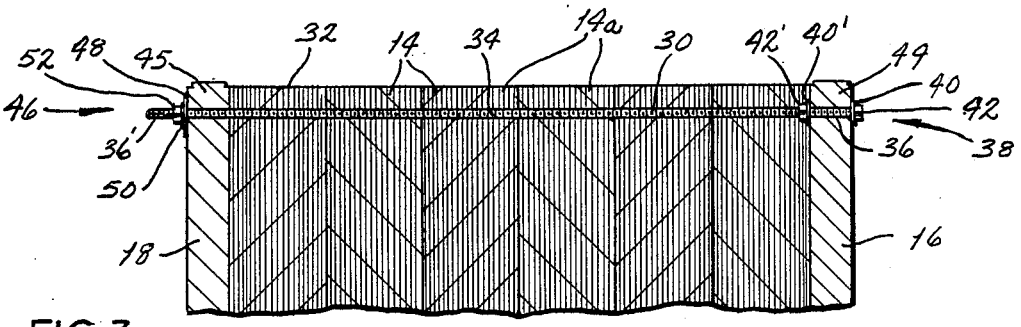
FIG. 3
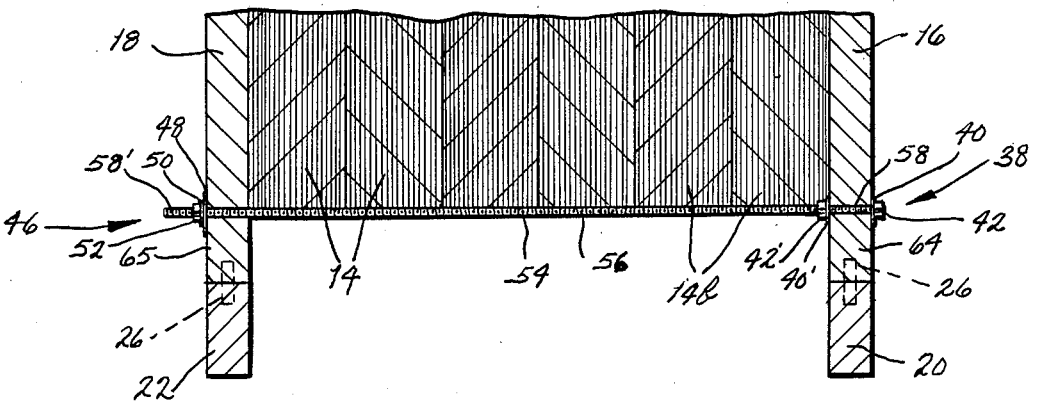

FIG. 4
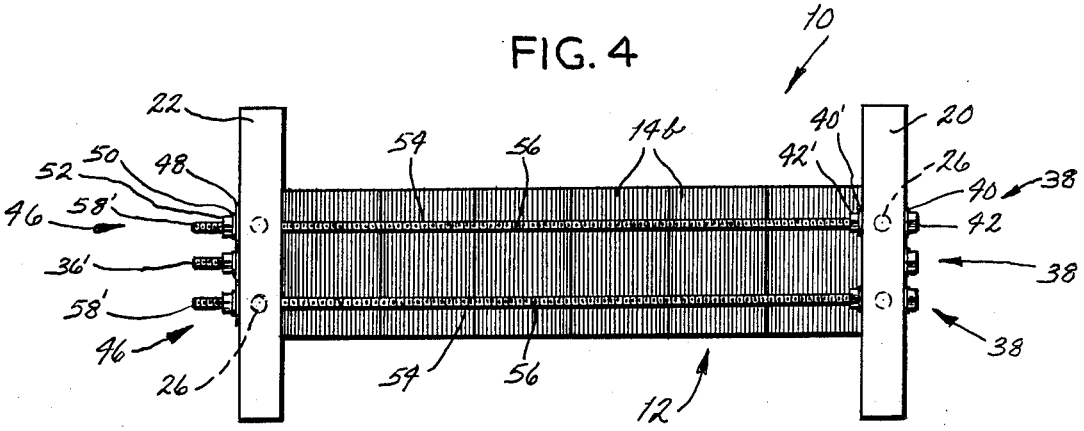
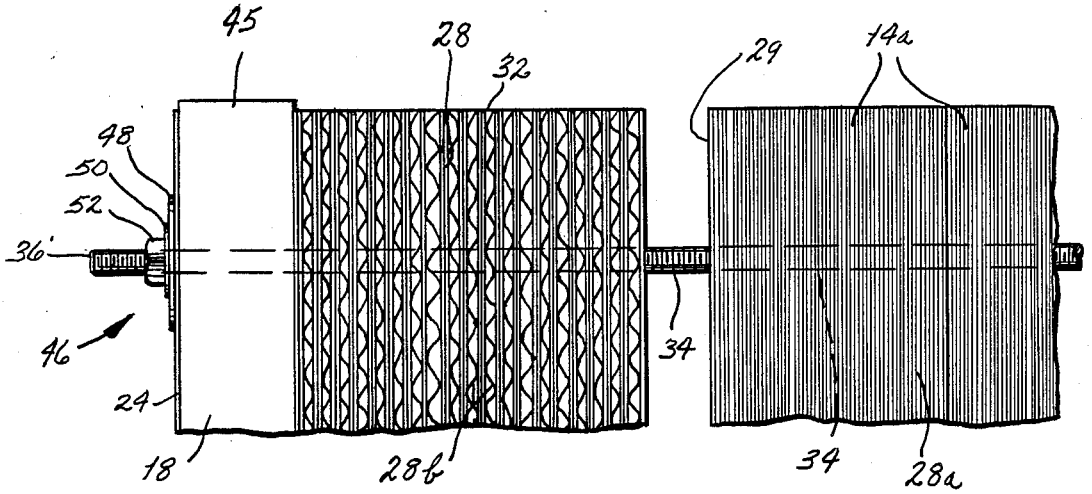
FIG. 5

ARCHERY TARGET

BACKGROUND OF THE INVENTION:

1. Field of the Invention

This invention relates, in general, to the field of archery, and, more particularly, to a target having multiple, interchangeable, replaceable modules for use either indoors or outdoors.

2. Description of the Prior Art

Heretofore, segmented archery targets have been known. For example, U.S. Pat. No. 3,329,431 to Roesner reveals an archery target having three horizontal sections, which are arranged one above the other and preferably with boards disposed against the upper surface of the upper section and against the lower surface of the lower section. The total structure containing the three sections is secured as by binding cords. Each section is comprised of a multiplicity of excelsior packet units which are arranged in stacked relationship. The entire structure is encompassed within a cover sheet which is secured at the top by sewing strips. Roesner does not reveal the easily replaceable interchangeable units of the present target.

U.S. Pat. No. 4,235,444 to Meyer also discloses an archery target comprised of a multiplicity of sections or components. However, the Meyer target sections are made up of elements, each being of a three-part character and comprising exterior penetrable membranes within which there is a pair of layers formed of resilient porous or foam polypropylene, with there being a strip of sheet polyethylene serving as an additional penetrable membrane. The Meyer components are quite structurally distinct from those of the present invention which contains sections adapted for simpler assembly than those of Meyer.

U.S. Pat. No. 4,294,452 to Schlotter et al. contains a plurality of corrugated plug-type sections which are inserted into cavities within a wall member. Thus, the Schlotter et al. structure, overall, is quite distinct from the combination of components in the present structure.

SUMMARY OF THE INVENTION

Accordingly, it is an object of the present invention to provide a target for use in practicing archery shots which is simple in design, having a minimum of parts, and comprises interchangeable modules which are easily replaced and may be adjusted or tightened even by a child.

It is another object of the present invention to provide a target having the features stated which is capable of being used either indoors or outdoors.

It is a further object of the present invention to provide a target having the features stated which is portable, modular, and compact enough to be easily transported and yet of sufficient substance and strength as to withstand extended repeated use.

It is a still further object of the present invention to provide a target having the features stated which permits arrows to penetrate a front surface thereof without passing entirely through the target.

It is still another object of the present invention to provide a target having the features stated which is capable of supporting in a facile manner an inexpensive, disposable, conventional paper or plastic target image.

It is yet another object of the present invention to provide a target having the features stated which may be readily manufactured in various sizes, as may be desired by consumers for a variety of purposes.

In furtherance of these objects, the present invention is, briefly, an archery target comprising a target body having a plurality discrete, substantially identical, elongated modules arranged in side-by-side relationship, with the longest dimension extending vertically, and first and second opposed upright supports having upper and lower ends for forming the sides of the target and framing the target body therebetween. The target has laterally disposed base members for mounting the upright supports in a vertical position in relation to the ground or other surface, and target body attachment elements for connecting the target body to the upright supports. The elongated modules are constituted of blocks of laminated layers of corrugated sheeting formed so as to have smooth side surfaces and rough cut surfaces. The modules are arranged such that the smooth side surfaces abut each other. The target body attachment elements comprise rods for supporting the target body elongated modules thereon each having an end adapted for rigid connection to the first upright support and the opposite rod end for adjustable connection to the second upright support.

BRIEF DESCRIPTION OF THE DRAWINGS

FIG. 1. is a perspective view of an archery target constructed in accordance with and embodying the present invention.

FIG. 2 is an end elevational view of the target shown in FIG. 1.

FIG. 3 is a vertical sectional view of the target taken on the line 3—3, of FIG. 2.

FIG. 4 is a bottom plan view of the target shown in FIG. 1.

FIG. 5 is an exploded partial front view of the target shown in FIG. 1, illustrating the corrugated texture of the target body modules.

DESCRIPTION OF THE PREFERRED EMBODIMENT

Referring now to the drawings, FIG. 1 shows an archery target constructed in accordance with and embodying the present invention, generally designated 10. Target 10 consists basically of a body 12, horizontally penetrated and suspended by an elongated member 30 (FIG. 3) which further penetrates two rigid, leg-like upright supports 16, 18 extending upwardly from base members 20, 22, respectively, for positioning target 10 in a vertical posture relative to the support surface.

Target body 12 is comprised of a plurality of elongated modules 14 each being rectangular in cross-section and cut from stacks of sheets of compressed and glued corrugated cardboard, and having upper ends 14*a* and lower ends 14*b*; the corrugations or rough cut surfaces 28 may be directed either vertically 28*a* or horizontally 28*b* (FIG. 5) with equal effect. However, modules 14 should preferably be positioned such that the smooth side surfaces 29 thereof are adjacent to each other and the corrugations 28 face outwardly.

Modules 14 are longitudinally positioned and maintained between first and second spaced apart upright supports 16, 18 which latter are each preferably comprised of wood, such as cedar, which is relatively light weight and naturally resistant to rotting from exposure to the weather and thus does not require weatherproofing, painting or other covering. However, upright supports 16, 18 could be comprised of other woods or conceivably of metal, or plastic as of the thermosetting type.

Upright supports 16, 18 are situated centrally and vertically upon horizontal base supports 20, 22, respectively, and preferably are attached thereto by wooden dowels 26, shown in FIGS. 2, 3 and 4, in phantom. Dowels 26 are snuggly imbedded in both upright 16, 18 and horizontal 20, 22 supports and glued therein. Optionally, upright supports 16, 18, may be attached to base members 20, 22 by other means, such as braces or bolts, and may be formed with a beveled edge 24, for example, for a more decorative appearance.

Aligned openings (not shown) are provided on elongated modules 14 and upright supports 16, 18 near the upper ends 44, 45 of such supports and centrally in regard to depth, approximately 1 inch below the flat surface 32 of the upper ends 14a of modules 14 thus suspended between upright supports 16, 18. A rigid elongated member, or rod, 30 penetrates modules 14 via said aligned openings. Rod 30 is preferably formed so as to be threaded along the central portion or shaft 34 as well as being threaded at the ends 36 thereof, as shown in FIGS. 3 and 5. However, rod 30 could alternatively be smooth along shaft 34 to permit easier penetration of the aligned openings of elongated modules 14.

In addition to the suspension provided thereto by rod 30 modules 14 are also supported by two parallel horizontal elongated members 54, such as metal rods, which further interconnect upright supports 16, 18 at the lower ends 64, 65 respectively, thereof and provide a seat therebetween for target body 12, as well as structural support for target 10 generally (FIGS. 3 and 4). Rods 54 may be either threaded, as shown, or smooth and unthreaded along central portion 56 thereof. Ends 58 of rods 54 are threaded, similarly to ends 36 of upper rod 30, and are attached as described above by adaptors 38, 46 to upright supports 16, 18, respectively. Alternatively, rods 54 may penetrate modules 14 near their lower ends 14*b* in like manner as rod 30 penetrates the upper ends 14*a*. However, for simplicity of assembly, blocks 14 may merely abut or seat upon rods 54.

Rods 30, 54 are each attached rigidly at one end thereof to upright support 16 and adjustably at the other end thereof to upright support 18. Threaded ends 36, 36', 58, 58' permit securing rods 30, 54 to upright supports 16, 18 at the upper 44, 45 and lower ends 64, 65 thereof by rod end adaptors 38, 46. Rod end adaptors 38 comprise washers 40 sandwiched between nuts 42 and the outside of upright support member 16. Likewise, washers 40' are sandwiched between nuts 42' and the inner surface of upright support 16. Each such washer 40, 40' and nut 42, 42' fit over threaded ends 36, 58 to attach same to upright support 16.

By contrast, rods 30, 54 are adjustably attached at the opposite ends thereof to upright support 18 by rod end adaptors 46, which are located only on the outside of upright support member 18 and are comprised of a large inner washer 48 and an adjacent, smaller outer washer 50; each such washer 48, 50 being held firmly against upright support 18 by a nut 52 which latter threadably engage ends 36', 58' respectively, of rods 30, 54. When target 10 is in assembled form rod end adaptors 38 remain stationary on upright support 16, nuts 42 being positioned flush with rod ends 36, 58, while rod end adaptors 46 can be adjusted along the laterally outwardly extending threaded ends 36', 58' of rods 30, 54, respectively. Thus, if modules 14 should become loose or wear thin with use, adaptors 46 can be adjusted by merely tightening nuts 52 to force upright supports 16, 18 into relatively closer relationship, thereby compressing modules 14 by reason of the compaction of the associated corrugations. Thus modules 14 will become denser and will continue to resist penetration therethrough by an arrow.

Target 10 may be made available in various sizes, in increasing increments, as in the order of four inches in both length and width, depending on the use required and the size of the module. Patently, target 10 is serviceable to a wide range of users, such as children or professional archers or hunters. Being substantially impenetrable and compact, target 10 may be used in many environments; for example, it is suitable for use indoors, in an appropriate room. Upright supports 16, 18, being preferably constructed of cedar, will resist rotting; whereby target 10 may be also used outdoors for long periods of time without harm to the permanent parts thereof.

As by way of example, each module 14 is comprised of approximately 19 layers of compressed cardboard, and has a burst test, in the final form thereof, of approximately 275 pounds per square inch, against flat surface 29. Target body 12 as assembled is of such density that an arrow will not penetrate entirely through the target, as may occur with conventional targets.

Although lightweight and inexpensive, modules 14 are of such density and construction as to be able to withstand as many as a thousand arrow strikes and still be quite usable. If the centermost modules 14 of target 10 become loose or relatively more worn than those closer to upright supports 16, 18 the user may merely apply a conventional wrench to nuts 52 to tighten upright supports 16, 18 with respect to modules 14, thereby forcing the latter into closer or mutually snug relation. The user may then continue employing the same modules 14 in the new arrangement. If some modules 14 eventually become very worn, for example, by a relatively expert marksman who frequently makes strikes near the same area, the relative disposition thereof may be changed by merely removing adaptors 46, withdrawing upright support 18 and sliding modules 14 from rods 34, 54. Then, for example, those modules 14 that were centermost, and hence the most worn, can be moved outward, adjacent to side supports 16, 18 with the erstwhile outer modules 14 replacing same as the central portion of target body 12, and in effect, truly present a new target. Thus, a great deal of use may be obtained from one set of modules 14 and after excessive use and subsequent wear, replacements may be relatively inexpensively obtained for some or all of the originals. Accordingly, the life of target 10 is materially enhanced by this shifting of modules 14 as that the effective life of target body 12 is easily doubled.

Additionally, the present invention permits placement over target body 12 of a paper or plastic target (not shown), such as a picture of a bull's eye or even a picture of an animal to be hunted, for example, a deer. Such disposable targets are easily and inexpensively available and thus may be replaced as frequently as necessary without simultaneous replacement of the entire target 10 or body 12.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. An archery target comprising a target body having an assembly of discrete, elongated modules, first and second opposed, upright supports having upper and lower ends for forming the sides of said target and framing said target body therebetween, base members for mounting said upright supports in a vertical position relative to the ground or other surface, and target body attachment means for connecting said target body to said upright supports; each of said elongated modules comprising a plurality of mutually adhered, discrete, sheet-like elements; said target body attachment means for connecting said target body assembly modules to each of said upright supports and comprising therefore first adaptor means, for rigid securement to said first upright support, and second adaptor means for adjustable securement to said second upright support.

2. An archery target as defined in claim 1, wherein said elongated modules are comprised of a plurality of mutually adhered, discrete, sheet-like elements consisting of cellulosic material and having smooth side surfaces and rough cut surfaces arranged such that the smooth side surfaces abut each other.

3. An archery target as defined in claim 1, wherein said elongated modules are comprised of a plurality of mutually adhered, discrete, sheet-like elements being corrugated in nature.

4. An archery target as defined in claim 2, wherein said cellulosic, sheet-like elements are corrugated in nature.

5. An archery target as defined in claim 1, wherein said first and second upright supports and said elongated modules are provided with aligned openings penetrating the upper ends thereof and said target body attachment means comprises at least a first rod extending through said openings and projecting at the ends thereof beyond the first and second upright members to suspend said modules therefrom and to present said modules and said upright supports in mutually tight relationship; means engaging the opposite ends of said first rod; and wherein said target body attachment means further comprises at least a second rod; said second rod having threaded ends and extending between and penetrating said upright supports beneath and adjacent to said target body module lower ends, for providing base support for said modules; and means for engaging the opposite ends of said second rods for attachment thereto of said first and second upright supports.

6. An archery target as defined in claim 1, wherein said upright supports are formed of lengths of two inch by four inch cedar boards.

7. An archery target as defined in claim 1, wherein said target body is comprised of at least six of said target body modules, each being substantially three and a half inches in width, four inches in depth, and two feet in length.

8. An archery target as defined in claim 1, wherein said target body modules are all of the same length and are at least four in number, the length of said modules being selectively variable such that as more modules are used, increasing the width of said target, longer modules may be used so that the target body is substantially square in hape; and wherein the length of said target upright supports is selectively variable, in order to support a target body of increasing size.

9. An archery target as defined in claim 8, wherein said target upright supports are provided with openings at equal distances along the lengths thereof for receiving said elongated members for attaching target body modules of various lengths; and wherein said elongated members are rigid and of such length as to be capable of attaching a target body of increased width to said side support means.

10. The target of claim 5, wherein said first rod is smooth along the center portion thereof for facilitating passage of said elongated member through the aligned openings.

11. An archery target as defined in claim 5, wherein said upright supports and said modules are provided with aligned openings at the lower ends thereof and said target body attachment means comprises multiple rods having threaded ends, at least one of said rods for penetrating said target body elongated modules at the upper ends thereof and at least one of said elongated members for penetrating said target body elongated modules at the lower ends thereof for suspending and attaching said elongated modules to and between said first and second upright supports in mutually tight relationship.

12. An archery target comprising a target body having a plurality of discrete, elongated modules, first and second opposed, upright supports having upper and lower ends for forming the sides of said target and framing said target body therebetween, base members for mounting said upright supports in a vertical position relative to the ground or other surface, and target body attachment means for connecting said target body to said upright supports; said elongated modules comprising a plurality of mutually adhered, discrete, sheet-like elements; said target body attachment means comprising rods for connecting said target body elongated modules to each of said upright supports and further comprising rod end adaption means for rigidly connecting said rods to said first upright support and further rod end adaption means for adjustably connecting said elongated members to said second upright support; said elongated modules being comprised of a plurality of mutually adhered, discrete, sheet-like elements consisting of corrugated cellulosic material and having smooth side surfaces and rough cut surfaces arranged such that the smooth side surfaces abut each other; said first and second upright supports and said elongated modules being provided with aligned openings penetrating the upper ends thereof and said target body attachment means comprising at least one first rod extending through said openings and projecting at the ends thereof beyond the first and second upright supports to present said modules and said upright supports in mutually tight relationship; means engaging the opposite ends of said first rod; said target body attachment means further comprising at least one second rod support having threaded ends and extending between and penetrating said upright supports beneath and adjacent to said target body module lower ends, for providing base support for said modules; and means for engaging the opposite ends of said second rod for attachment thereto of said first and second upright supports.

* * * * *